United States Patent [19]

Schuster-Woldan et al.

[11] 4,058,432

[45] Nov. 15, 1977

[54] PROCESS FOR PRODUCING A THIN METAL STRUCTURE WITH A SELF-SUPPORTING FRAME

[75] Inventors: Hans Schuster-Woldan, Woerthsee-Steinebach; Kaspar Weingand, Lochham; Dirk Koch, Munich, all of Germany

[73] Assignee: Siemens Aktiengesellschaft, Berlin & Munich, Germany

[21] Appl. No.: 667,531

[22] Filed: Mar. 17, 1976

[30] Foreign Application Priority Data

Mar. 19, 1975 Germany ..... 2512086

[51] Int. Cl.[2] ..... H01L 21/312

[52] U.S. Cl. ..... 156/659; 29/160; 96/36; 156/661; 156/664; 204/11; 204/15; 313/348

[58] Field of Search ..... 156/3, 7, 8, 11, 13, 156/15, 16, 18, 24, 272, 632, 644, 659, 661, 664; 427/43, 44, 53, 54, 123, 143, 243, 247, 259, 264, 270, 272, 282, 287 R, 497 R, 407 A, 408, 404, 405; 96/36, 36.1, 36.4; 204/11, 15, 23, 37 R, 38 E; 29/160, 25.14, 191.4, 25.17; 101/128.3, 128.4; 313/348; 428/137

[56] References Cited

U.S. PATENT DOCUMENTS

| | | | |
|---|---|---|---|
| 2,499,977 | 3/1950 | Scott | 156/7 |
| 2,829,460 | 4/1958 | Golay | 101/128.3 |
| 2,933,436 | 4/1960 | Miller et al. | 204/11 |
| 3,037,896 | 6/1962 | Gauntt et al. | 156/13 |
| 3,130,487 | 4/1964 | Mears | 29/160 |
| 3,192,136 | 6/1965 | Reid | 96/36 |
| 3,197,391 | 7/1965 | Bowers | 156/13 |
| 3,329,541 | 7/1967 | Mears | 156/11 |
| 3,451,902 | 6/1969 | Levinds | 204/15 |
| 3,458,370 | 7/1969 | Cone | 156/3 |
| 3,476,658 | 11/1969 | Corwin | 427/247 |

*Primary Examiner*—Charles E. Van Horn
*Assistant Examiner*—J. J. Gallagher
*Attorney, Agent, or Firm*—Hill, Gross, Simpson, Van Santen, Steadman, Chiara & Simpson

[57] ABSTRACT

A process for producing a thin metal structure with a self-supporting frame, such as a grid, characterized by forming a galvanic resistant coating on a first surface of a carrier member with the coating exposing portions of the first surface adjacent the end of the carrier member and portions of the first surface in the configuration of the metal structure to be formed, depositing a layer of metal on the exposed portion of the first surface, removing the galvanic resistant coating, applying an etch resistant coating on the edges of thecarrier member and at least a portion of a second surface adjacent the edges of the carrier member and then selectively etching the carrier member to remove the carrier member except for that portion protected by the etch resistant coating to form the thin metal structure mounted on a self-supporting frame. The carrier member may either be a single member or a multi-layer member which has a metal coating forming the first surface. The process when using a multi-layer includes providing a protective layer on the metal structure and etching away the majority of the carrier member and then subsequently etching the metallic layer and protective layer to produce the metal structure on the frame.

10 Claims, 10 Drawing Figures

PROCESS FOR PRODUCING A THIN METAL STRUCTURE WITH A SELF-SUPPORTING FRAME

BACKGROUND OF THE INVENTION

Field of the Invention

The present invention is directed to a process for producing a thin metal structure with a self-supporting frame and in particular for producing a grid structure.

Prior Art

Thin metal structures, such as grids, are used as masks in electron lithography and x-ray shadow copying and may be used as thin filmed aperture diaphragms for corpuscular beam devices. Another use of thin grids is for impedance measurements in gas detection equipment. In each of these uses, the structural dimensions of the metal structure are generally in a micron and submicron range. Thus, the production and handling of these grids presents many problems.

In particular, for the further miniaturization of integrated circuits with the aid of an electro-optical structure production, metallic transmission masks with very fine grids are required as carriers of an active structure. The transmission masks are produced by vapor depositing an adhesive layer and a metallic layer onto a mask carrier. Then the mask structure is electro-deposited on the metallic layer. Subsequent to the completion of the transmission mask, it is freed from the carrier by dissolving the metallic layer or by being mechanically pulled therefrom. The dissolving of the metallic layer is a lengthy process and the mechanical removing of the transmission mask involves the problems of damage or destruction of the mask structure. In addition, the transmission mask structure must be handled including mounting it in a frame. Due to the fine structure in the mask structure, the handling of these mask structures presents many problems.

SUMMARY OF THE INVENTION

The present invention is directed to providing a simple and economical process for the production of thin metal structures with a self-supporting frame which process reduces difficulties with respect to handling.

To accomplish these tasks, the process comprises the steps of providing a carrier member having a size of a self-supporting frame and first and second surfaces, forming a galvanic resistant coating on the first surface of the carrier member, said coating exposing portions of said first surface adjacent each of the edges of the carrier member and portions of the first surface in the configuration of the metal structure to be formed with all portions being interconnected, galvanically depositing a layer of metal on the exposed portion of the first surface, removing the galvanic resistant coating, applying an etch resistant coating on the edges of the carrier member and at least a portion of the second surface adjacent the edges of the carrier member, and selectively etching the carrier member to remove all of the carrier members except that portion protected by the etch resistant coating to form the thin metal structure mounted on a self-supporting frame. The process results in extremely good accuracy of the size of the metal structure which may be easily handled due to the mechanical stable frame. The previously necessary steps of mounting the finished metal structure on a frame have been eliminated. Since the metal structures are constructed on the carrier and from the beginning are firmly connected to the region forming the frame, the metal structures are tightly stretched on the frame.

In one embodiment of the invention, the carrier member is a sheet of metal which is different than the metal being used for forming the metal structure and which can be selectively removed without the metal structure being attacked.

In another embodiment, the carrier member is a mutli-layer carrier having at least two layers with a thin metallic layer forming the first surface of the carrier member. The process includes, subsequent to the step of removing the galvanic resistant coating, a step of applying a protective metal coating on the metal structure and the exposed surfaces of the metallic layer and the step of etching comprises etching with a first solution to selectively remove exposed portions of the carrier member except for the metallic layer and subsequently etching with a second etching solution to remove the exposed portions of the metallic layer and the protective metal coating. Preferably, the protective metal coating is of the same metal as the metallic layer. This embodiment enables utilizing electrically insulating carrier materials such as glass, ceramic or synthetic materials to form part of the supporting frame. In the event of an unsatisfactory adhesion of the metallic layer on the insulating carrier material, a bonding or adhesive layer may be interposed therebetween. Since the thin metal structure is completely protected by the metallic layer and the protective metal layer, the first etching solution will not come in contact therewith. Thus, it is only necessary that the first etching solution is a solution which will etch or remove the layers of the carrier member without attacking the metallic layer and the protective metal layer. The various metal layers, such as the protective metal layer and the metal forming the metal structure, are preferably applied by electrodepositing.

In each of the embodiments, the galvanic resistant coating is preferably formed by a photolithographic process which comprises applying a layer of photosensitive material on the first surface, exposing the photosensitive layer through a mask having a desired configuration for the metal structure to be formed and the portions adjacent the edges, and then developing the photosensitive layer to expose portions of the first surface in the configuration of the metal structure and the portions adjacent the edges of the carrier member.

To remove internal stresses present in the metal structure and the frame, preferably the metal structure and self-supporting frame are heated to temper the structure and frame.

DESCRIPTION OF THE PREFERRED EMBODIMENTS

Figure 1:
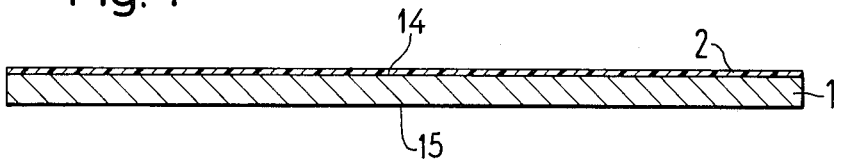
FIGS. 1–4 are cross-sectional views illustrating various stages in forming the metal structure and frame of the present invention.
Figure 2:
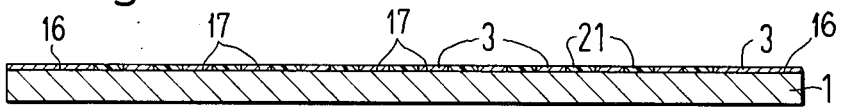
Figure 4:
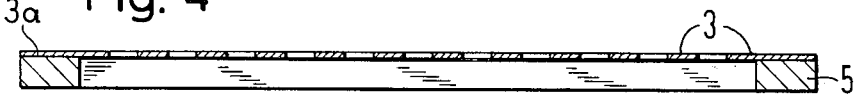

The principles of the present invention are particularly useful for producing a thin metal structure such as a grid 3 with a supporting frame 5 (FIG. 4). To produce the thin metal structure 3 with the supporting frame 5, a metal carrier member 1 havng a first surface 14 and a second surface 15 is provided. A thin layer 2 of photopolymeric material is applied on the first surface 14 (FIG. 1). The layer 2 has a sufficient thickness such as 1 μm and the carrier member 1 has a thickness of approximately 800 μm. The layer 2 is subjected to a photolithographic process, which uses a chrome parent mask to provide a high degree of accuracy to produce a galvanic resistant coating 21 (FIG. 2). This coating 21 leaves portions 16 of the first surface 14 exposed adjacent each of the edges of the carrier member 1 and portions 17 in the configuration of the metal structure 3 which is to be formed and the portions 16 and 17 are interconnected. After forming the covering 21, the metal structure 3 is formed by galvanic depositing metal on portions 16 and 17 of the first surface 14 which portions are not protected by the covering 21. Preferably, this depositing is by electroplating and is effected at a maximum thickness to the level of the remaining portion of the covering 21 so that the structure 3 has a thickness of approximately 1 μm.

Figure 3:
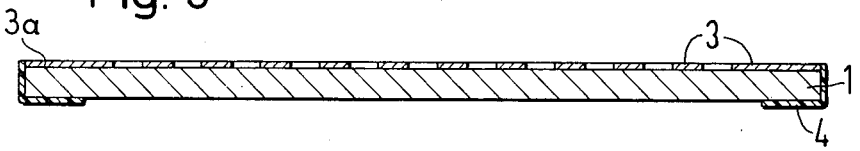

After forming the metal structure 3, the protective coating 21 is removed (FIG. 3) and an etch resistant covering 4 is applied to the edges of the carrier member 1 and a portion of the second surface 15 adjacent the edges. After applying the etch resistant covering, which may be an etch resistant lacquer, the carrier member is selectively etched away in all areas except that area which is protected by the covering 4 and a continuous border or margin portion 3*a* of the metal structure 3 which was plated on portion 16 of the surface 14. After the etching, the covering 4 is removed to leave the metal structure 3 which is firmly attached by border portion 3*a* to the frame 5.

To selectively etch the carrier member 1 without attacking the metal structure 3, the etching is accomplished with a selective etching agent. Therefore, the metals for which a suitable selective etching agent can be found must be selected for the carrier member 1 and for the metal structure 3. Metal pairing and etching agents of this type are used for example in the production of printed circuit boards in accordance with a subtractive technique and such metal pairing and etching agents are described in relevant literature. For example, the carrier member can consist of brass and the metal structure 3 may be nickel. With such a selection, an alkaline etching agent which consists of sodium chlorite, ammonia and ammonium carbonate will selectively etch the brass carrier member. A mixture of chromic acid and sulfuric acid is another suitable agent for selectively etching the brass without etching the nickel.

Figure 5:
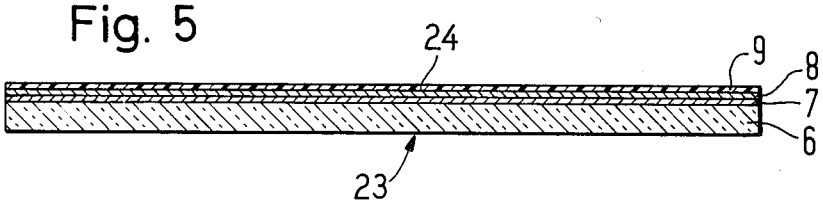
FIGS. 5–9 are cross-sectional views showing various stages of an embodiment of the process for forming the metal structure and frame in accordance with the present invention.
Figure 6:
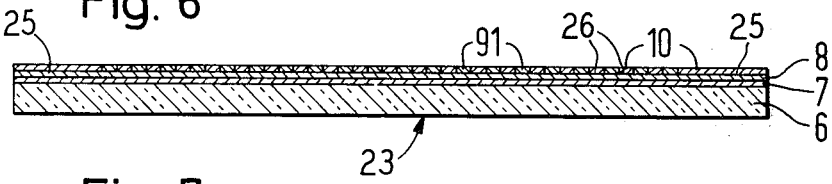
Figure 9:
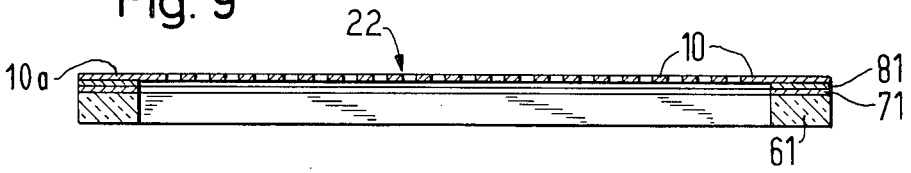
Figure 10:
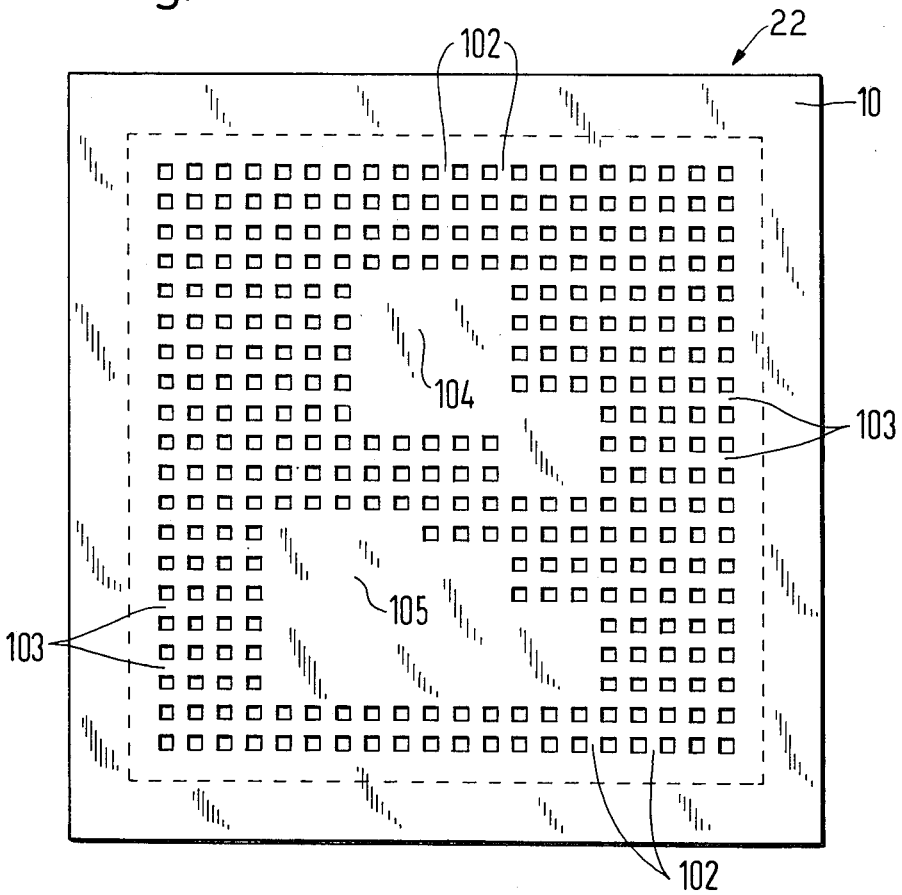
FIG. 10 is a plan view of a finished metal structure formed in accordance with the present invention.

In a second exemplary embodiment of the process, a metallic transition mask generally indicated at 22 in FIGS. 9 and 10 is produced. The mask 22 is particularly useful in electron lithography. To produce the mask 22, a multi-layer carrier member 23 (FIG. 5) comprising a square glass plate 6 having a side length of approximately 90 mm and a thickness of aporoximately 800 μm is provided on a surface 24 with an adhesive layer 7 which consists of titanium and has a thickness of approximately 0.02 μm. The layer 7 is preferably provided by being vapor deposited onto the glass plate 6. On the surface of the layer 7 a metal layer 8 of copper is vapor deposited to a thickness of approximately 0.5 μm. The layer 8 whose outer surface 24 forms a first surface of the carrier member 23 has a photo lacquer layer 9 of a thickness of 1 μm applied thereto. The photo lacquer layer 9 is exposed to light in a contact copy process through a chrome parent mask and is then subsequently developed to form the galvanic resistant covering 91 (FIG. 6). The covering 91 leaves exposed portion 25 around the edges of the carrier member 22 and leaves a pattern of exposed portions 26 which have a shape of a metal structure to be formed and the portions 25 and 26 are interconnected.

Figure 7:
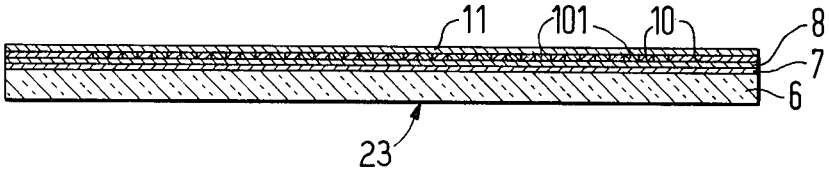

After forming the galvanic resistant covering 91, the metal structure 10 of nickel is galvanically deposited on those exposed portions 25 and 26. The galvanic depositing is done in a suitable nickel bath during which the metallic layer 8 is connected as a cathode. After completion of the electroplating, the galvanic resistant covering 91 is removed and a protective metal layer or coating 11 is galvanically deposited on the metal structure 10 and on the surface 24 of the metallic layer 8 in the areas 101 between the metal structure 3 so that the metal structure is completely surrounded by the copper of the protective metal coating 11 and the copper of the metallic layer 8 (FIG. 7).

Figure 8:
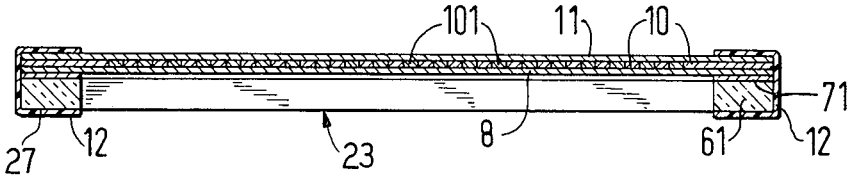

After the step of applying the protective layer 11, an etch resistant layer 12, which may be, for example, a strip of adhesive, is applied to the edges of the carrier member 23 and, as illustrated in FIG. 8, covers a portion of the layer 11 adjacent the edges and a portion of an exposed surface 27 of the glass member 6. The region of the exposed member 6 which is not covered by the etch resistant material 12 is etched away so that a supporting glass frame 61 remains. The etching agent is in the form of a hydrofluoric acid, which, in addition to etching the glass member 6, will etch away the titanium of the adhesive layer 7 except for a portion 71 which is protected and does not come in contact with the acid. Since the metal structure for the mask structure 10 is embedded between the metallic layer 8 and the etch protecting layer 11, it does not come into contact with the acid and there is no danger of even a slight etching attacked thereof.

After the first etching step, the etch resisting cover 12 is removed and the assembly is subjected to a second etching step, which removes the protecting metal layer 11, the metallic layer 8 and the regions 101 that were between the metal structure 10. The only portion of the layer 8, which is not removed during the second etching step, is a portion 81 which is protected by a border or margin portion 10*a* of the metal structure 10 and the glass frame 61. The second etching solution is a purely selective etching agent which attacks only the layers 8 and 11 without attacking the material forming the metal structure 10. An example of such an agent is ammoniacal sodium-chlorite etching agent which attacks only the copper of the layers 11, the zones 101 and the layer 8 but will not attack the nickel of the metal structure 10.

After removing the copper, the portion 10*a* of the metal structure 10 will remain in firm connection to the frame zones 81, 71 and the glass frame 61. In order to remove possible internal stresses, the finished transmission mask is then tempered for approximately 16 hours and at a temperature of 100° C. The structure 10 which consists of nickel, adapts itself to the differing heat expansion of the glass frame 61 so that it always remains tightly stretched after the tempering step.

The metal structure 10, as illustrated in FIG. 10, consists of a grid provided with arms or portions 102 which extend at right angles to arms or portions 103. As illustrated in FIG. 10, the structure also includes portions or active structures 104 and 105, which will be impermeable to an electron beam and are supported by the extremely fine grid having the portions 102 and 103 which portions will have a width of approximately 1 μm so that they will not cast a shadow during the electron lithographic process. In other words, the width of the portions 102 and 103 is so small that the electron beams will irradiate anything extending directly there behind during the lithographic process.

While the illustration in FIG. 10 only shows two portions 104 and 105, which are impermeable to the electron beam and will mask the beam from portions during a photolithographic process, any number of these portions such as 104 and 105 with any shape may be provided in the structure 10. To obtain the desired pattern which will produce the mask structure 10, the photo lacquer layer 9 (FIG. 5) may be exposed with the aid of a chrome parent mask which contains both the pattern of the grid and also the pattern of the active structures or portions 104 and 105. However, using a positive acting photo lacquer layer 9 it is also possible to carry out the exposure of the photo lacquer layer 9 in two stages using a first chrome parent mask to portray the grid structure and then using a second chrome parent mask to portray the active structures or portions. In both cases, an outstanding accuracy to size is achieved. When the mask structure 10 possesses a picture size of $50 \times 50$ mm, the maximum deviation from the employed chrome parent mask is always below 1 μm. This means that the relative accuracy to size of the mask structure 10 is always better than $2 \times 10^{-5}$.

While the above stated materials for forming a metal structure with a supporting frame have proved advantageous, it is possible to use a number of other materials whose selection is governed merely by the following criterion. The two materials for the layers such as 1 and 3 in the embodiment of FIGS. 1–4 or the layers 8 and 10 must have different etch resistance and there must be an etching agent which will selectively etch one without attacking the other. Thus, it is possible to use gold for the metal structure 10 and a synthetic material for the carrier using an etching agent which will act on the synthetic carrier member to form the frame. An example is a mixture of sulfuric acid and hydrofluoric acid which can be used for example to etch a glass fiber reinforced epoxy resin carrier.

In the above given examples, the dimensions were described for producing a particular structure such as a mask structure for electron lithography. These do not represent the upper limits of the dimensioning accuracies which can be achieved. In addition, experiments with the process of the present invention were utilized to produce extremely fine self-supporting metal grids having a thickness of 0.5 μm.

Although various minor modifications may be suggested by those versed in the art, it should be understood that we wish to employ within the scope of the patent granted hereon, all such modifications as reasonably and properly come within the scope of our contribution to the art.

We claim:

1. A process for producing a thin metal structure, such as a grid, with a self-supporting frame which has a thickness substantially greater than the thickness of the thin metal structure, the process comprising the steps of providing a carrier member having a size and thickness of the self-supporting frame and first and second surfaces, forming a galvanic resistant coating on the first surface of the carrier member, said coating exposing portions of said first surface adjacent each of the edges of the carrier member and portions of the first surface in the configuration of the metal structure to be formed with all portions being interconnected, galvanically depositing a layer of metal on the exposed portions of the first surface to produce the thin metal structure having a continuous border portion, removing the galvanic resistant coating, applying an etch resistant coating on the edges of the carrier member and at least a portion of the second surface adjacent the edges of the carrier member, selectively etching the carrier member to remove all of the carrier members except that portion protected by the etch resistant coating to form the thin metal structure mounted on a self-supporting frame.

2. A process according to claim 1, which further includes heating the thin metal structure and self-supporting frame to temper said structure and frame.

3. A process according to claim 1, wherein the step of forming a galvanic resistant coating utilizes a photolithographic process which comprises applying a layer of photosensitive material on said first surface, exposing the photosensitive layer through a mask having the desired configuration for the metal structure to be formed and the portions adjacent the edges, and developing the photosensitive layer to expose portions of the first surface in the configuration of the metal structure and the portions adjacent the edges of the carrier member.

4. A process according to claim 1, wherein said step of providing a carrier member provides a multi-layer carrier member having at least two layers with a thin, metallic layer forming said first surface of the carrier member.

5. A process according to claim 4, which includes subsequent to the step of removing the galvanic resistant coating, applying a protective metal coating on the metal structure and exposed surfaces of the metallic layer and wherein the step of etching comprises etching with a first etching solution to selectively remove exposed portions of the carrier member except for the metallic layer and subsequently etching with a second etching solution to remove exposed portions of the metallic layer and the protective metal coating.

6. A process according to claim 5, which further includes heating the thin metal structure and self-supporting frame to temper said structure and frame.

7. A process according to claim 5, wherein the step of forming a galvanic resistant coating utilizes a photolithographic process which comprises applying a layer of photosensitive material on said first surface, exposing the photosensitive layer through a mask having the desired configuration for the metal structure to be formed and the portions adjacent the edges, and developing the photosensitive layer to expose portions of the first surface in the configuration of the metal structure and the portions adjacent the edges of the carrier member.

8. A process according to claim 5, wherein the step of applying a protective metal coating is accomplished by galvanic deposition of a metal which is identical to the metal of the metallic layer.

9. A process according to claim 8, wherein the step of forming a galvanic resistant coating utilizes a photolithographic process which comprises applying a layer of photosensitive material on said first surface, exposing the photosensitive layer through a mask having the desired configuration for the metal structure to be formed and the portions adjacent the edges, and developing the photosensitive layer to expose portions of the first surface in the configuration of the metal structure and the portions adjacent the edges of the carrier member.

10. A process according to claim 8, which further includes heating the thin metal structure and self-supporting frame to temper said structure and frame.

* * * * *